US006023249A

United States Patent [19]

Fujita et al.

[11] Patent Number: 6,023,249

[45] Date of Patent: Feb. 8, 2000

[54] COMMUNICATION APPARATUS FOR A WIRELESS LOCAL AREA NETWORK

[75] Inventors: Takao Fujita, Fujisawa; Rie Suzuki, Yokohama, both of Japan

[73] Assignee: Canon Kabushiki Kaisha, Tokyo, Japan

[21] Appl. No.: 08/714,599

[22] Filed: Sep. 16, 1996

[30] Foreign Application Priority Data

Sep. 18, 1995 [JP] Japan ..... 7-238404
Sep. 12, 1996 [JP] Japan ..... 8-241930

[51] Int. Cl.[7] ..... H01Q 1/24; H01Q 1/10

[52] U.S. Cl. ..... 343/883; 343/702; 343/878

[58] Field of Search ..... 343/702, 883, 343/878, 880, 888, 700 MS, 887, 890; 455/90; H01Q 1/24, 1/10

[56] References Cited

U.S. PATENT DOCUMENTS

| | | | |
|---|---|---|---|
| 2,565,661 | 8/1951 | Lidz | 343/702 |
| 2,757,370 | 7/1956 | Scheldorf | 343/896 |
| 3,268,898 | 8/1966 | Colony | 343/872 |
| 5,541,609 | 7/1996 | Stutzman et al. | 343/702 |
| 5,644,320 | 7/1997 | Rossi | 343/702 |

*Primary Examiner*—Hoanganh Le
*Attorney, Agent, or Firm*—Fitzpatrick, Cella, Harper & Scinto

[57] ABSTRACT

A wireless LAN system is configured using a communication apparatus for a wireless LAN including an antenna unit comprising an antenna, or an antenna and at least a part of a circuit of the system provided as one body, and a support for supporting the antenna unit. In addition, a pedestal for the support configured so that a terminal device for transmission or reception can be disposed thereon.

62 Claims, 8 Drawing Sheets

COMMUNICATION APPARATUS FOR A WIRELESS LOCAL AREA NETWORK

BACKGROUND OF THE INVENTION

1. Field of the Invention

This invention relates to a wireless communication apparatus, and more particularly, to a communication apparatus for a wireless LAN (local area network).

2. Description of the Related Art

Conventional communucation apparatuses for a wireless LAN are configured such that, as shown in FIG. 9, a main body 4 and antennas 5 are provided as one body, or that an antenna portion is removed from the main body and is installed at a position where the antenna portion is well observed.

However, the above-described conventional approaches have the following problems:

In a wireless LAN system, since communication is performed using radio waves as a communication medium, it is desirable that communication apparatuses for a wireless LAN in communication are placed at positions where the apparatuses are well observed from one another. On the other hand, in an ordinary office environment, it is desirable to place each of such communication apparatuses on a desk close to a terminal. However, the display of the terminal, documents and the like which are taller than the communication apparatus are usually placed on a desk so that a situation in which the communication apparatuses cannot be observed from one another easily occurs. Furthermore, since the number of offices which have partitions for separating desks from one another is increasing, the situation is further degraded. In order to improve such situations, there is an attempt in which antenna portions are removed to provide for other units, and the antenna units are only installed at positions where the units are well observed from one another. In such a case, also, since it is inconvenient to permanently install the antenna units considering, for example, the case of movement of offfice facilities, it is difficult to securely install the antenna units without imparing esthetic appearance.

SUMMARY OF THE INVENTION

It is an object of the present invention to secure a situation in which antenna units are well observed from one another even in the above-described environment.

It is another object of the present invention to provide a situation in which each antenna unit need not be placed at a position separated from a terminal, as well as to secure a situation in which antenna units are well observed from one another even in the above-described environment.

It is still another object of the present invention to achieve space saving on desks, as well as to secure a situation in which antenna units are well observed from one another even in the above-described environment.

According to one aspect, the present invention which achieves these objectives relates to a communication apparatus for a wireless local area network comprising an antenna unit comprising an antenna or an antenna and at least a part of a circuit of a system provided as one body, supporting means for supporting the antenna unit, and pedestal means serving as a pedestal for the supporting means and configured so that a terminal device for transmission or reception can be disposed thereon.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

First Embodiment

Figure 1:
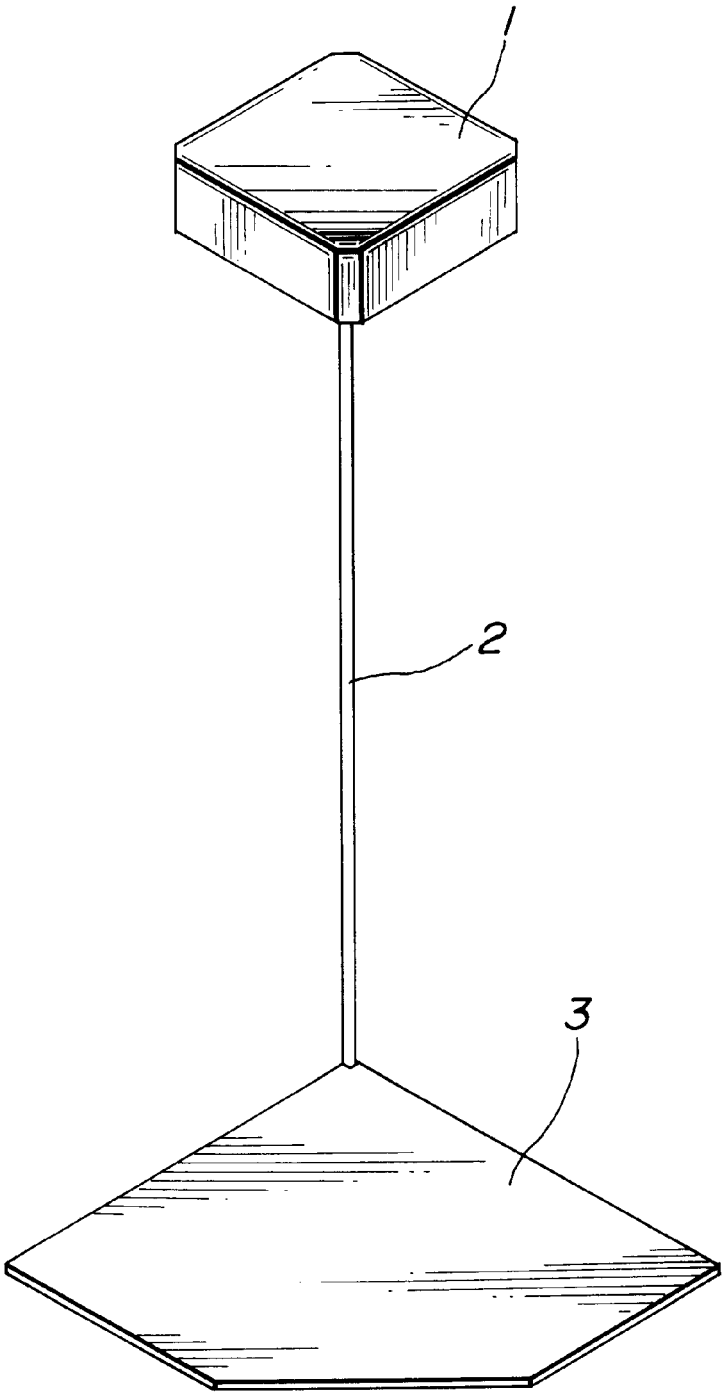
FIG. 1 is a diagram illustrating the configuration of a communication apparatus for a wireless LAN according to a first embodiment of the present invention.

FIG. 1 illustrates a communication apparatus for a wireless LAN according to a first embodiment of the present invention. In FIG. 1, there are shown an antenna unit 1, a support 2 for supporting the antenna unit 1, and a pedestal 3 for fixing the support 2.

Figure 6:
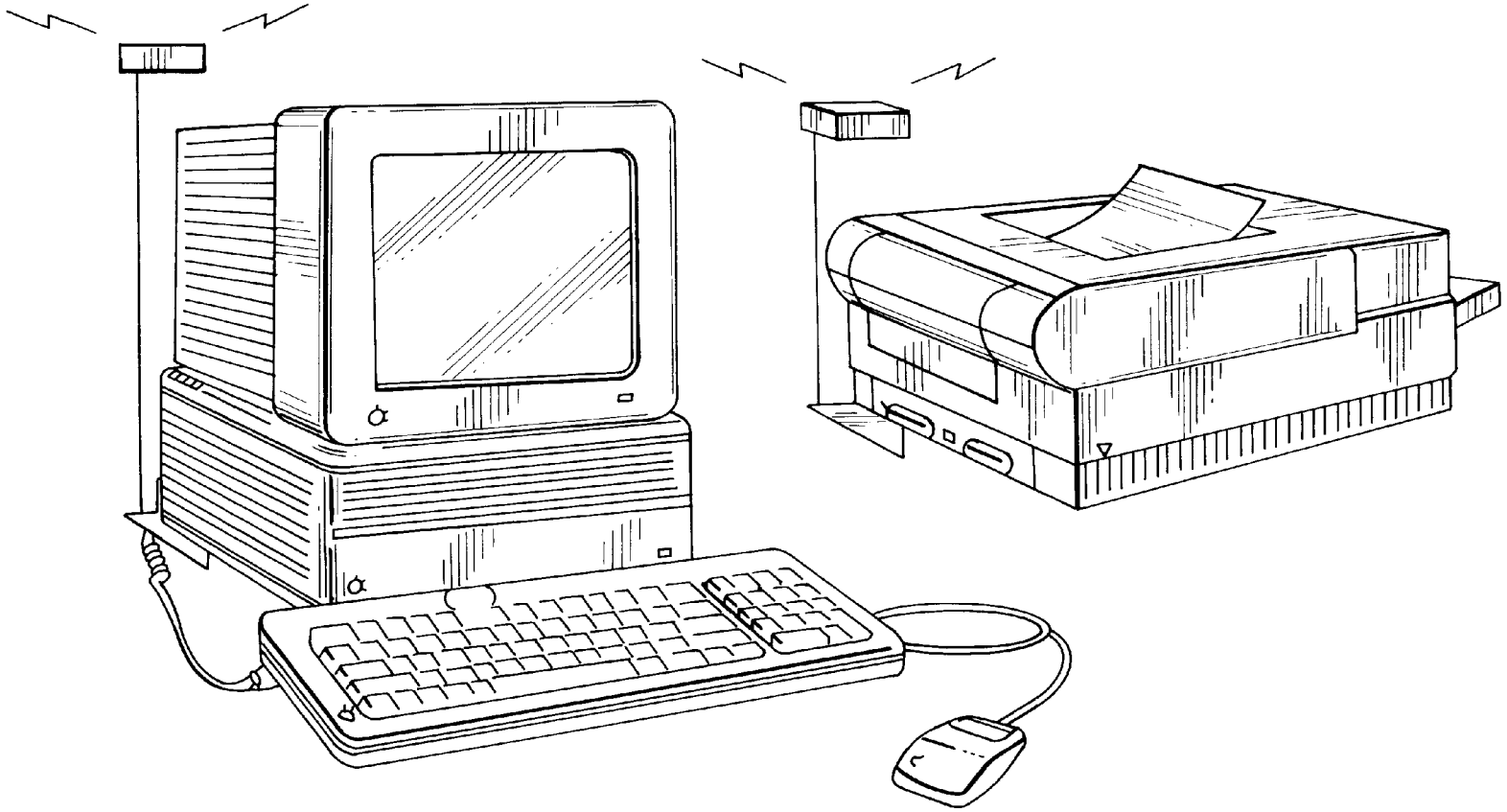
FIG. 6 is a diagram illustrating the configuration of a wireless LAN system realized by the present invention.
Figure 7:
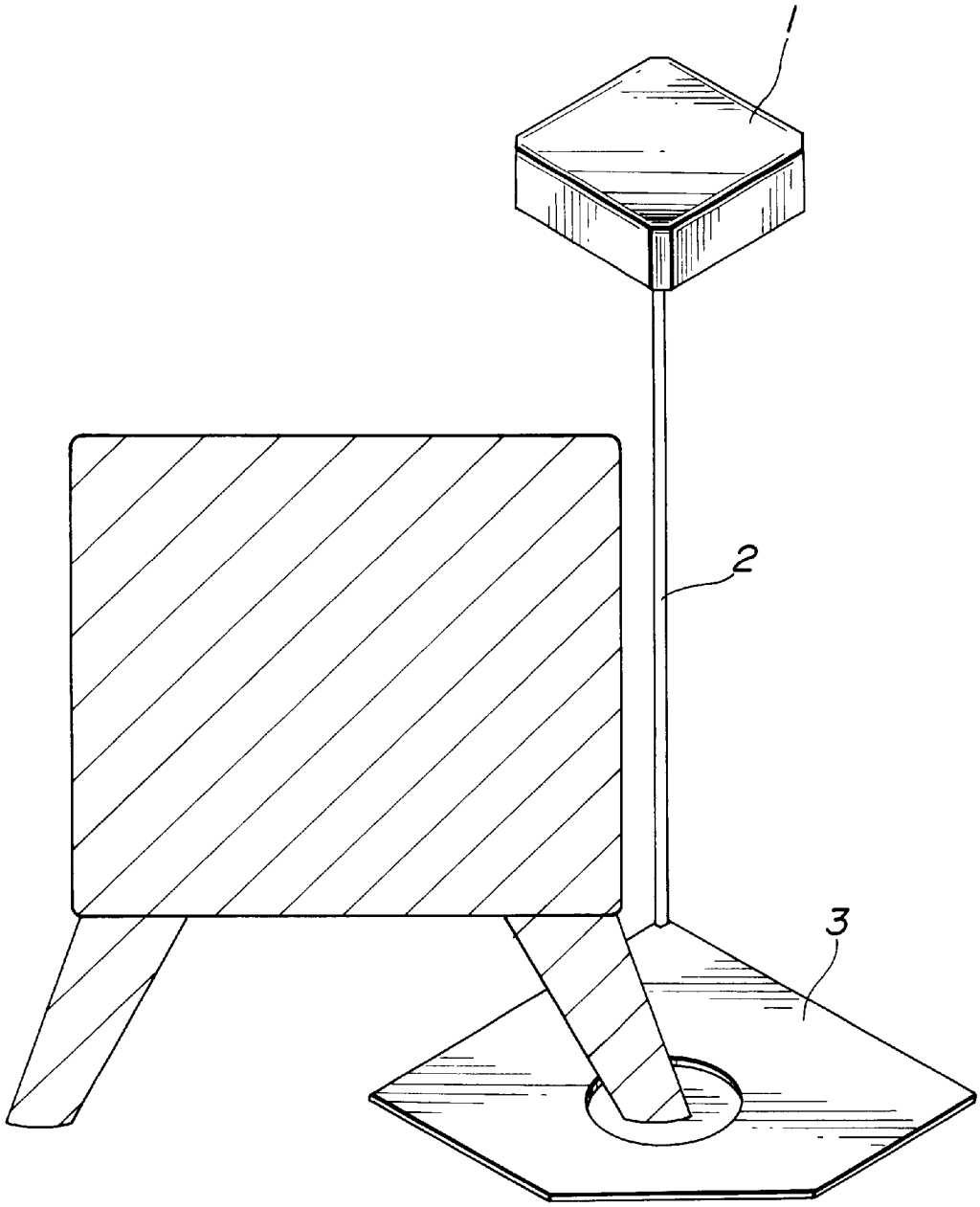
FIG. 7 is a diagram illustrating the configuration of a communication apparatus for a wireless LAN when a hole is provided in a pedestal.

The antenna unit 1 may comprise only an antenna, or an antenna integrated with the main body of the apparatus having a reduced size. Electric wires pass within or along the support 2 so as to be connectable to a terminal, a power supply or the like. The pedestal 3 includes, in some cases, a connector or a circuit for connection to the terminal, the power supply or the like. As can be seen from FIG. 1, by making the pedestal 3 thin, it can be placed under an apparatus, such as a connected terminal or the like. If, for example, a foot of the apparatus is an obstacle, the foot may be disposed in a hole provided in the pedestal 3 as shown in FIG. 7. According to such a configuration, a wireless LAN system as shown in FIG. 6 can be realized. As is apparent from FIG. 6, since the support is sufficiently tall, influence by obstacles disappears, and therefore communication apparatuses for a wireless LAN can easily communicate with one another. Furthermore, since the base of each terminal is placed on the pedestal of the corresponding communication apparatus, the terminal and the apparatus can be closely disposed without using a large space.

Second Embodiment

However, an office environment where various obstacles having different heights, such as displays, documents, partitions and the like, are present, it is difficult to secure a state in which communication apparatuses for a wireless LAN are well observed from one another, according to the above-described approach of the first embodiment in which a support has a fixed height.

Figure 2:
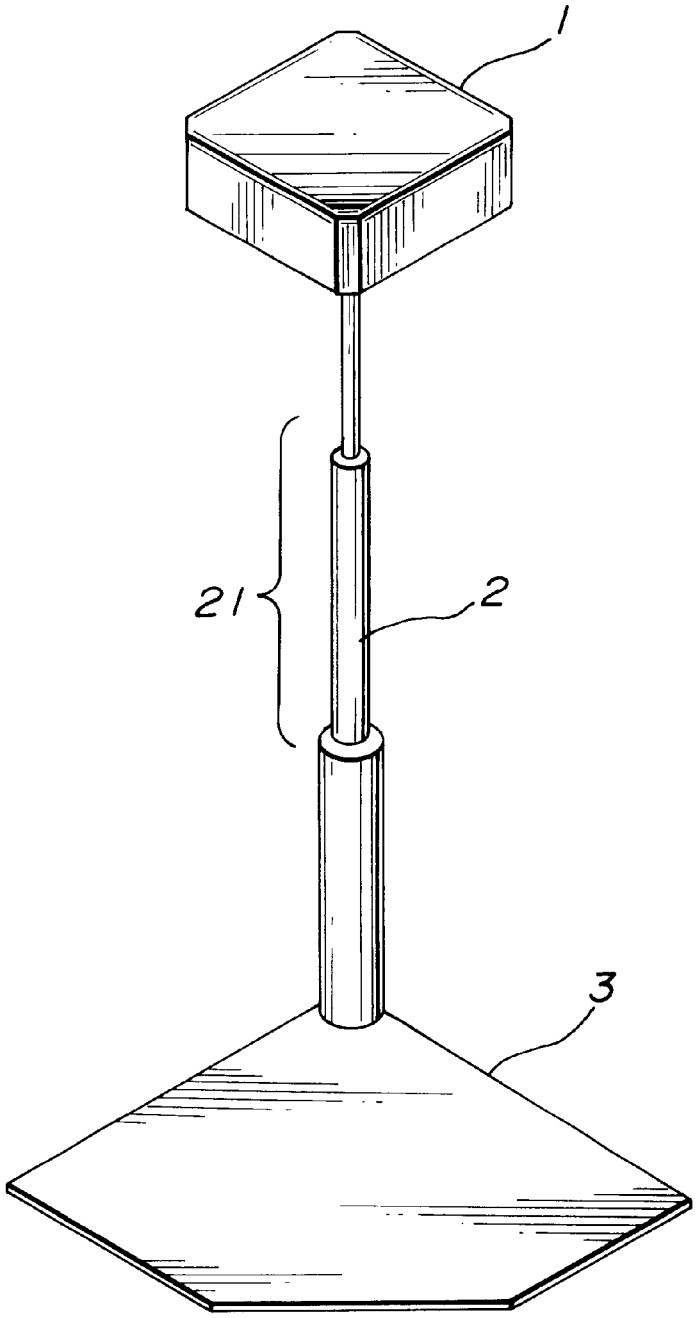
FIGS. 2 and 3 are diagrams illustrating the configuration of a communication apparatus for a wireless LAN according to a second embodiment of the present invention.
Figure 8:
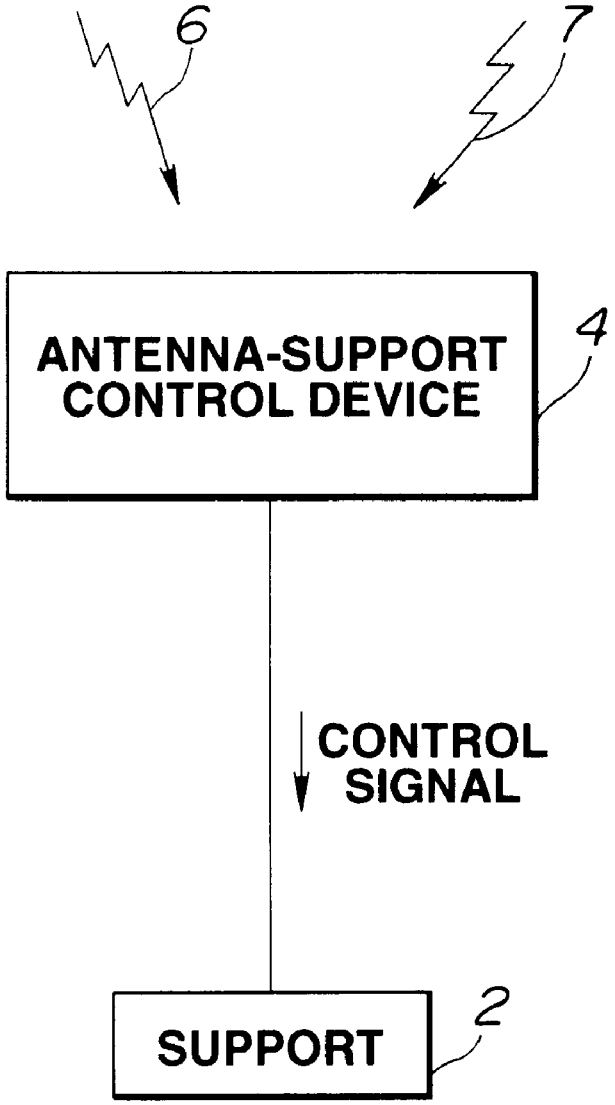
FIG. 8 is a diagram illustrating the configuration of an antenna-support control device.
Figure 9:
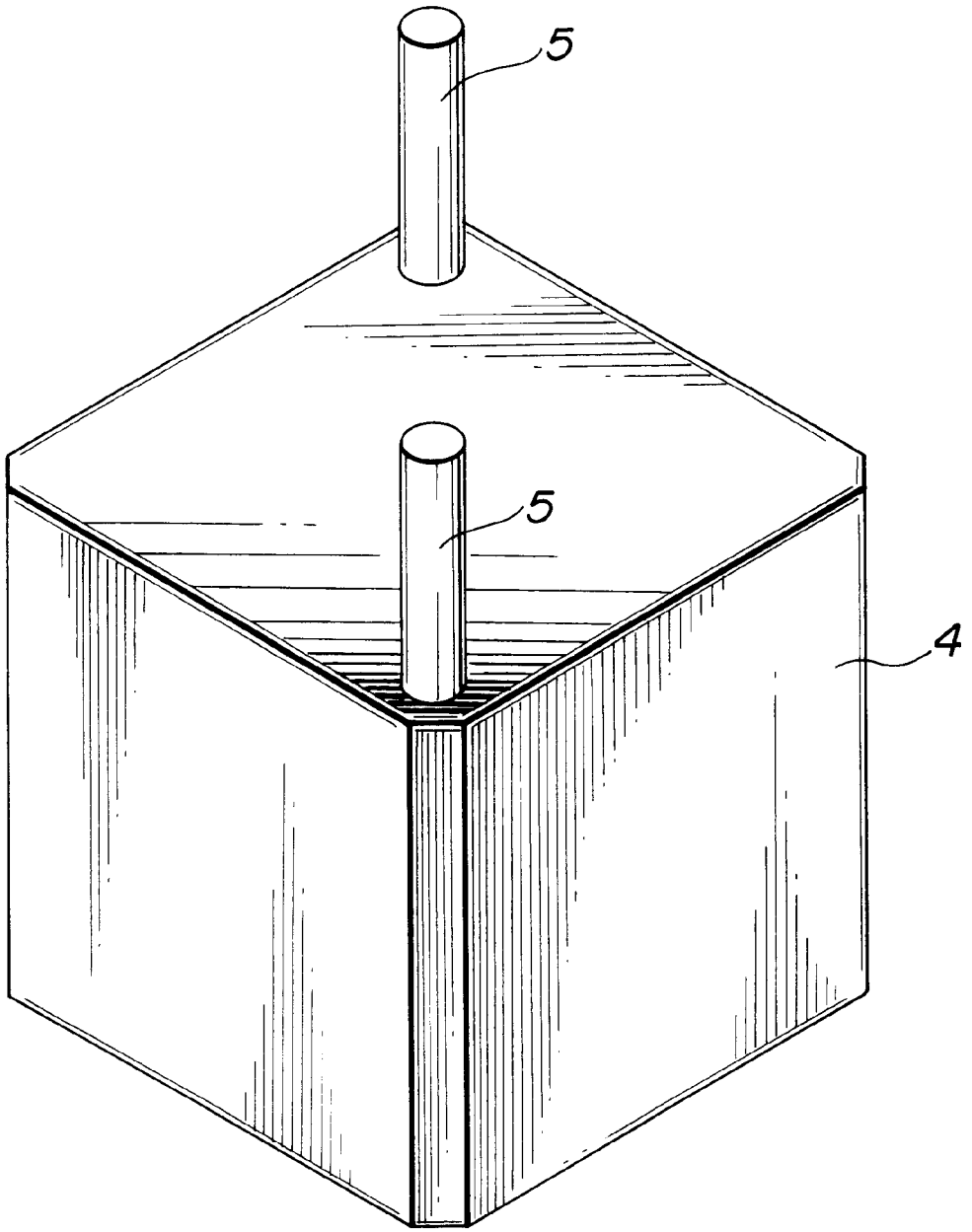
FIG. 9 is a diagram illustrating the configuration of a conventional communication apparatus for a wireless LAN.

In a second embodiment of the present invention, as shown in FIG. 2, a support 2 is extensible/retractable so that the height of an antenna unit 1 can be manually or automatically changed. When, as shown in FIG. 8, an antenna-support control device 4 for automatically controlling the extension/retraction of the support 2 is provided, the antenna-support control device 4 measures and monitors the intensity of the received electric field 6, the error rate of pilot data 7, or the like, and outputs a control signal to control the height of the antenna support 2 so that the antenna unit 1 is disposed at a position to provide an optimum state of reception. This control may be performed only when setting initial conditions, or at every predetermined time interval, or at every reception of data packet.

Figure 3:
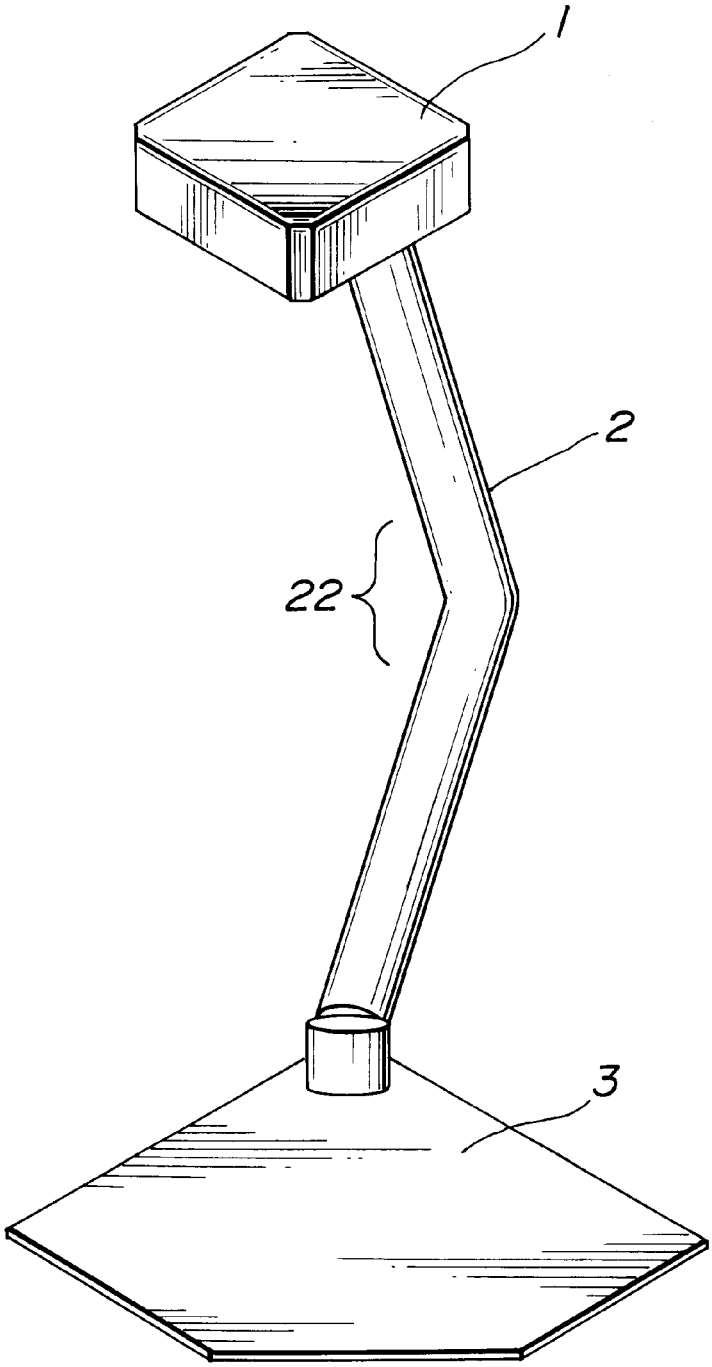
Figure 4:
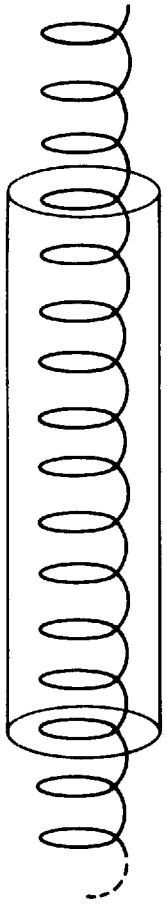
FIG. 4 is a diagram illustrating the configuration of a signal line in the present invention.
Figure 5:
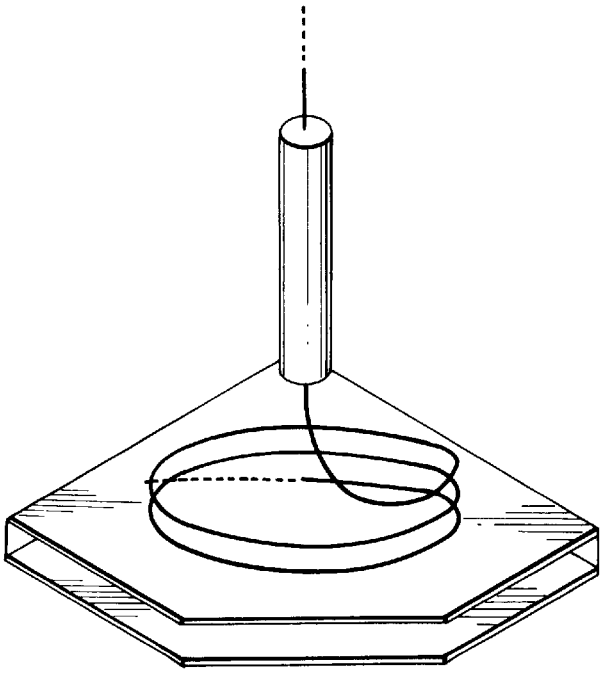
FIG. 5 is a diagram illustrating the configuration of another signal line in the present invention.

The support 2 may comprise, for example, as shown in FIG. 2, a plurality of tubes 21, or may comprise, as shown in FIG. 3, at least one joint 22. When the support 2 is extensible/retractable, electric wires within or along the support 2 may have a spring-like shape as shown in FIG. 4, or may be accommodated within the pedestal or the antenna unit as shown in FIG. 5.

As described above, according to the present invention, in an ordinary office environment, it is possible to configure a wireless LAN system in which antennas are well observed from one another. It is also possible to reduce influence by various obstacles, such as displays, partitions and the like, in accordance with a situation. When moving office facilities as will frequently occur in an office, the facilities may be moved together with respective communication apparatuses for a wireless LAN integrated therewith. Hence, the movement is simplified compared with the conventional approach in which only antenna portions are separately placed.

According to the present invention, simplified flat antennas can be provided, and terminals and antennas can be closely disposed so that the antennas need not be placed at positions separated from the terminals. Furthermore, since the communication apparatus of the present invention has a simple external appearance, it can be installed so as not to impair the esthetic appearance of an office.

According to the present invention, by providing a thin pedestal, a part of the pedestal can be placed under the connected terminal apparatus to provide a structure that does not occupy a large space on a desk.

According to the present invention, by providing a support having at least one joint, it is possible to install an antenna unit so as to evade another apparatus or the like on a desk, and therefore to achieve saving of space on the desk.

According to the present invention, by providing a function of automatically adjusting the length of a support in accordance with the state of reception, a complicated antenna installing method is not required, and it is possible to always maintain an optimum state of reception.

The individual components shown in outline or designated by blocks in the drawings are all well known in the communication apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A communication apparatus for a wireless local area network, said apparatus comprising:

an antenna unit comprising an antenna;

supporting means for supporting said antenna unit; and pedestal means serving as a pedestal for said supporting means, wherein said pedestal means has a thin, plate-like shape, so dimensioned as to be capable of receiving a terminal device disposed thereon.

2. An apparatus according to claim 1, wherein said antenna unit has a flat shape.

3. An apparatus according to claim 1, wherein said supporting means has a structure for passing electric wires axially.

4. An apparatus according to claim 1, wherein said pedestal means includes a connector for connection to a terminal device.

5. An apparatus according to claim 1, wherein said pedestal means includes a hole for disposing a foot of a terminal device therein.

6. An apparatus according to claim 1, wherein said supporting means has a variable length.

7. An apparatus according to claim 6, further comprising control means for controlling variable length of said supporting means.

8. An apparatus according to claim 1, wherein said supporting means includes at least one bendable joint.

9. An apparatus according to claim 8, further comprising control means for controlling bending of said joint.

10. An apparatus according to claim 1, wherein said antenna unit comprises said antenna and at least part of a circuit of a system provided as one body.

11. An apparatus according to claim 1, wherein said pedestal means includes a connector for connection to a power supply.

12. A communication apparatus for a wireless local area network, said apparatus comprising:

an antenna;

a support; and a pedestal, wherein said pedestal has a thin, plate-like shape, so dimensioned as to be capable of receiving a terminal device disposed thereon.

13. An apparatus according to claim 12, wherein said antenna has a flat shape.

14. An apparatus according to claim 12, wherein said support has a structure for passing electric wires axially.

15. An apparatus according to claim 12, wherein said pedestal includes a connector for connection to a terminal device.

16. An apparatus according to claim 12, wherein said pedestal includes a hole for disposing a foot of a terminal device therein.

17. An apparatus according to claim 12, wherein said support has a variable length.

18. An apparatus according to claim 17, further comprising a controller capable of controlling the variable length of said support.

19. An apparatus according to claim 12, wherein said support includes at least one bendable joint.

20. An apparatus according to claim 19, further comprising a controlling device for controlling bending of said joint.

21. An apparatus according to claim 12, wherein said antenna includes at least part of a circuit of a system.

22. An apparatus according to claim 12, wherein said pedestal includes a connector for connection to a power supply.

23. A communication apparatus for a wireless local area network, said apparatus comprising:

an antenna unit comprising an antenna;

supporting means for supporting said antenna unit, with said supporting means having a variable length;

pedestal means serving as a pedestal for said supporting means, said pedestal means having a share capable of receiving a terminal device disposed thereon; and control means for controlling the variable length of said supporting means, wherein said control means controls the length of said supporting means by measuring the intensity of received electric fields.

24. An apparatus according to claim 23, wherein said pedestal means has a thin, flat shape.

25. An apparatus according to claim 23, wherein said pedestal means has an opening therein capable of receiving the terminal device.

26. An apparatus according to claim 23, wherein said antenna has a flat shape.

27. An apparatus according to claim 23, wherein said supporting means has a structure for passing electric wires axially.

28. An apparatus according to claim 23, wherein said pedestal means includes a connector for connection to the terminal device.

29. An apparatus according to claim 23, wherein said supporting means includes at least one bendable joint.

30. An apparatus according to claim 29, further comprising a controlling device for controlling bending of said joint.

31. An apparatus according to claim 23, wherein said antenna includes at least part of a circuit of a system.

32. An apparatus according to claim 23, wherein said pedestal means includes a connector for connection to a power supply.

33. A communication apparatus for a wireless local area network, said apparatus comprising:

an antenna unit comprising an antenna;

supporting means for supporting said antenna unit, with said supporting means having a variable length;

pedestal means serving as a pedestal for said supporting means, said pedestal means having a shape capable of receiving a terminal device disposed thereon; and control means for controlling the variable length of said supporting means, wherein said control means controls the length of said supporting means by evaluating the error rate of pilot data.

34. An apparatus according to claim 33, wherein said pedestal means has a thin, flat shape.

35. An apparatus according to claim 33, wherein said pedestal means has an opening therein capable of receiving the terminal device.

36. An apparatus according to claim 33, wherein said antenna has a flat shape.

37. An apparatus according to claim 33, wherein said supporting means has a structure for passing electric wires axially.

38. An apparatus according to claim 33, wherein said pedestal means includes a connector for connection to the terminal device.

39. An apparatus according to claim 33, wherein said supporting means includes at least one bendable joint.

40. An apparatus according to claim 39, further comprising a controlling device for controlling bending of said joint.

41. An apparatus according to claim 33, wherein said antenna includes at least part of a circuit of a system.

42. An apparatus according to claim 33, wherein said pedestal means includes a connector for connection to a power supply.

43. A communication apparatus for a wireless local area network, said apparatus comprising:

an antenna;

a support having a variable length;

a pedestal, wherein said pedestal has a shape capable of receiving a terminal device disposed thereon; and a controller capable of controlling the variable length of said support, wherein said controller controls the length of said support by measuring the intensity of received electric fields.

44. An apparatus according to claim 43, wherein said pedestal has a thin, flat shape.

45. An apparatus according to claim 43, wherein said pedestal has an opening therein capable of receiving the terminal device.

46. An apparatus according to claim 43, wherein said antenna has a flat shape.

47. An apparatus according to claim 43, wherein said support has a structure for passing electric wires axially.

48. An apparatus according to claim 43, wherein said pedestal includes a connector for connection to the terminal device.

49. An apparatus according to claim 43, wherein said support includes at least one bendable joint.

50. An apparatus according to claim 49, further comprising a controlling device for controlling bending of said joint.

51. An apparatus according to claim 43, wherein said antenna includes at least part of a circuit of a system.

52. An apparatus according to claim 43, wherein said pedestal includes a connector for connection to a power supply.

53. A communication apparatus for a wireless local area network, said apparatus comprising:

an antenna;

a support having a variable length;

a pedestal, wherein said pedestal has a shape capable of receiving a terminal device disposed thereon; and a controller capable of controlling the variable length of said support, wherein said controller controls the length of said support by evaluating the error rate of pilot data.

54. An apparatus according to claim 53, wherein said pedestal has a thin, flat shape.

55. An apparatus according to claim 53, wherein said pedestal has an opening therein capable of receiving the terminal device.

56. An apparatus according to claim 53, wherein said antenna has a flat shape.

57. An apparatus according to claim 53, wherein said support has a structure for passing electric wires axially.

58. An apparatus according to claim 53, wherein said pedestal includes a connector for connection to the terminal device.

59. An apparatus according to claim 53, wherein said support includes at least one bendable joint.

60. An apparatus according to claim 59, further comprising a controlling device for controlling bending of said joint.

61. An apparatus according to claim 53, wherein said antenna includes at least part of a circuit of a system.

62. An apparatus according to claim 53, wherein said pedestal includes a connector for connection to a power supply.

* * * * *

UNITED STATES PATENT AND TRADEMARK OFFICE

CERTIFICATE OF CORRECTION

PATENT NO. : 6,023,249
DATED : February 8, 2000
INVENTOR(S) : Takao Fujita, et al.

It is certified that error appears in the above-identified patent and that said Letters Patent is hereby corrected as shown below:

After [73] Assignee, insert the following:

--[*] Notice: This patent issued on a continued prosecution application filed under 37 CFR 1.53 (d) , and is subject to the twenty year patent term provisions of 35 U.S.C. 154 (a) (2) .--

COLUMN 2:
Line 55, "an" should read --in an--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*